United States Patent [19]

Nemoto et al.

[11] 4,451,345

[45] May 29, 1984

[54] ELECTRODE SUPPORT DEVICE FOR CONTINUOUS ELECTROPLATING BATH

[75] Inventors: Hiroshi Nemoto; Kazuaki Miyachi; Akira Komoda, all of Chiba, Japan

[73] Assignee: Kawasaki Steel Corporation, Kobe, Japan

[21] Appl. No.: 528,165

[22] Filed: Aug. 31, 1983

[51] Int. Cl.[3] ..... C25D 17/00

[52] U.S. Cl. ..... 204/206

[58] Field of Search ..... 204/206, 1, 211, 286, 204/288

[56] References Cited

U.S. PATENT DOCUMENTS 2,569,578 10/1951 Rieger ..... 204/206

2,610,146 9/1952 Kompart ..... 204/206

*Primary Examiner*—Thomas Tufariello

*Attorney, Agent, or Firm*—Balogh, Osann, Kramer, Dvorak, Genova & Traub

[57] ABSTRACT

An electrode support device for a continuous electroplating bath includes current supply rotating drums whose parts are immersed in the electroplating bath, a metal strip to be plated being trained about the immersed parts of the rotating drums, and a number of arcuate consumable electrodes arranged side by side along generators of the rotating drums and successively movable on support surfaces of electrode supports so as to supply new consumable electrodes at one ends of the arranged electrodes and remove consumed electrodes from the other ends. According to the invention, the support device comprises adjusting means for adjusting the electrode supports to remove any unevenness of gaps between the metal strip and the consumable electrodes, thereby preventing failures due to unevenness of the gaps resulting from unavoidable irregular wear on support surfaces of the electrode supports and externally adjusting the gaps to meet electrolytic conditions to eliminate edge-overcoating which would occur when the width of the strip changes to be wider.

6 Claims, 11 Drawing Figures

43
52
44
50
50'
49
46
53
T
48
47
W
5

ELECTRODE SUPPORT DEVICE FOR CONTINUOUS ELECTROPLATING BATH

BACKGROUND OF THE INVENTION

1. Field of the Invention

This invention relates to an assembled electrode support device for a radial cell type electrolyte bath, and more particularly to an electrode support device for a continuous electroplating bath whose consumable electrode are progressively renewed to correct change in thickness of the electrodes due to melting away of the electrodes into the electrolyte.

2. Description of the Prior Art

In general, a radial type electrolytic cell has been used in for example continuous zinc plating lines for metal strips such as cold rolled thin plates. In order to carry out high speed electrolytic operation with much higher efficiency in this case, lower halves of large diameter rotating drums for current supply are immersed in an electrolyte in the cell, along which immersed lower halves is trained a metal strip introduced in and out of the cell, during which electric current is supplied from anodes arranged in opposition to the strip with gaps therebetween in radial directions of the drums.

Such an arrangement is advantageous for plating only one surface of a strip without plating the other surface thereof. Since, however, great electric power is required for a plant on large scale including such electrolytic cells, it is essential to maintain the gaps as small as possible so as to eliminate ineffective or superfluous consumption power.

In usual electroplating, there are two cases, in one case, anodes are insoluble, and in another, metal plates to be plated are soluble electrodes. Particularly, the latter case is simple in maintenance because of metal component continuously replenished from anodes and is useful particularly to obtain thick plating coating with large electric power because of less gass production at the electrodes.

In this case, however, the anodes tend to solve with proceeding of the plating so as to be thinner to progressively enlarge the gaps, thereby increasing electric resistance to decrease current density and therefore to progressively decrease plating deposition. In the plating system using soluble electrodes, accordingly, the enlarged gaps must be successively corrected in response to the consumption of the electrodes with the lapse of time.

In order to successively correct the gaps, it has been proposed to arrange a number of arcuate consumable electrodes side by side partially surrounding the current supply rotating drums in an electrolyte bath in a manner such that the consumable electrodes are progressively moved along generators of the cylindrical rotating drums. The consumable electrodes are moved along guides having gradients so as to cause them to approach the drums by consumed amount of the electrodes to maintain the gaps constant. The guides serve to supply current for the anodes consisting of the consumable electrode groups. Such guides are sometimes referred to as "electrode support".

In this manner, new consumable electrodes are supplied on one side of the current supply rotating drums and old consumed electrodes are removed on the other side of the drums to progressively move the consumable electrodes, thereby successively renewing the assembled electrodes or anodes while correcting the gaps between the anodes and plates to be plated.

In this case, the electric support is generally mainly made of a graphite rod having a fairly large square cross-section (approximately 450×450 mm) for fulfiling conditions required for such plants, i.e. corrosion-resistance to the electrolyte, low overvoltage and low cost.

As the above renewal of the anodes is considerably frequently effected, it causes wear on the surfaces of the electrode supports, which is due to simple mechanical friction but is accelerated by slight arc discharge between the surfaces of the supports and consumable electrodes, local overvoltage and the like, with the result that gaps increase between the anodes and plate to be plated in the proximity of the bottom of the electrolyte bath, while the upper ends of the anodes in the vicinity of the surface of the electrolyte bath approach the rotating drums which would cause short-circuit accident without taking a precaution against it.

If the electrode supports are not accurately positioned at the bottom of the electrolyte bath, the gaps cannot be properly kept while the consumable electrodes are being renewed. Accordingly, the electrode supports have been supported on stationary bases rigidly mounted on the bottom of the bath through support troughs having core members of (L-shaped) angle steels upwardly opening as shown in FIGS. 1*a* and 1*b*. A metal strip 2 passes along lower halves of the drums 1 immersed in the electrolyte bath T. Anodes 3 consist of groups of consumable electrodes 3' arranged side by side in opposition to the metal strip 2 with gaps G relative thereto in radial directions of the rotating drums 1. As shown in the drawing, the anodes 3 are arranged on opposite sides of an axis of the rotating drums 1 upstream and downstream of a running direction of the metal strip 2 and anchored on support surfaces 6 of the electrode supports 5 with the aid of protrusions 4 formed on outer surfaces of the consumable electrodes 3' so as to permit the electrodes 3' to be moved in succession along the support surfaces of the electrode supports. The electrode supports 5 are securely supported through the support troughs 8 on the stationary bases 9 rigidly mounted on the bottom of the bath.

In this case, however, even if the electrode supports 5 determining the gaps relative to the anodes 3 are properly positioned, gaps G' and G'' in the proximity of ends of the anodes 3 become narrow under the relative positional condition between the rotating drums and anodes and the wearing condition of the anodes as shown in FIGS. 2*a* and 2*b*, when a width of the metal strip 2 becomes wider as shown at 2'.

SUMMARY OF THE INVENTION

It is therefore a general object of the invention to provide an improved electrode support device for a continuous electroplating bath, whose electrode supports are adjustable to keep gaps properly between a metal strip to be plated and anodes during electrolytic operation progressively replenishing consumable electrodes constituting the anodes.

It is another object of the invention to provide an electrode support device for an electroplating bath whose anodes are supported on support troughs fixed to stationary bases, the support troughs being tiltable to compensate for wearing of electrode supports so as to keep gaps properly between a steel strip to be plated and anodes during electrolytic operation progressively replenishing consumable electrodes constituting the anodes.

It is a further object of the invention to provide an electrode support device for an electroplating bath, whose suspending means for electrode supports are adjustable so as to correct gaps between a metal strip to be plated and anodes to meet electrolytic conditions, thereby eliminating edge-overcoating of the strip.

In order to achieve the above objects, in an electrode support device for a continuous electroplating bath, including current supply rotating drums whose parts are immersed in said electroplating bath, a metal strip to be plated being trained about the immersed parts of the rotating drums, and a number of arcuate consumable electrodes arranged side by side along generators of said rotating drums and successively movable on support surfaces of electrode supports so as to supply new consumable electrodes at one ends of the arranged electrodes and remove consumed electrodes from the other ends, according to the invention the support device comprises adjusting means for adjusting said electrode supports to remove any unevenness of gaps between said metal strip and said consumable electrodes.

In a preferred embodiment of the invention, the adjusting means for each the electrode support comprises a support trough supporting the electrode support and a stationary base rotatably supporting the support trough so as to permit the support surface of the electrode support to be adjustably tilted and fixedly supporting the support trough thereon by means of adjusting bolts.

In another preferred embodiment of the invention, the adjusting means for each the electrode support comprises hanging members each supporting each end of the electrode support and upwardly extending from a surface of an electrolyte and further extending downward beyond an upper edge of a bath of the electrolyte, and translation guides each slidably guiding the lower end extending downward of each the hanging member in a direction substantially in parallel with a radial surface of said current supply rotating drums.

The invention will be more fully understood by referring to the following detailed specification and claims taken in connection with the appended drawings.

DETAILED DESCRIPTION OF THE PREFERRED EMBODIMENT

Figure 1A:
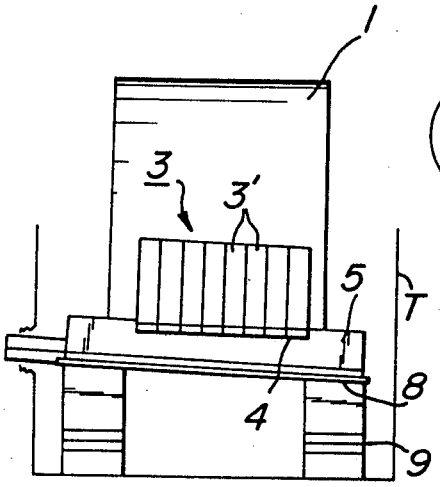
FIG. 1a PRIOR ART
FIG. 1*a* is a side view of a radial cell type electrolytic bath of the prior art.
Figure 1B:
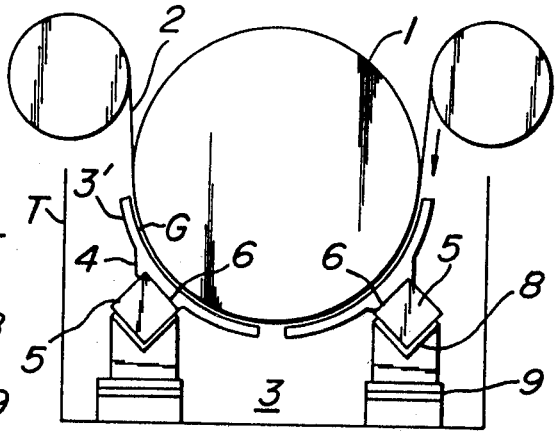
FIG. 1b PRIOR ART
FIG. 1*b* is a front elevation of the electrolyte bath shown in FIG. 1*a;*
Figure 2A:
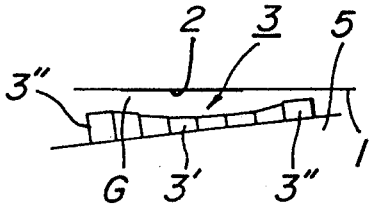
FIG. 2a PRIOR ART
FIGS. 2*a* and 2*b* are schematic partial views for explaining an occurrence of edge-overcoating due to increase in width of a metal strip to be plated.
Figure 2B:
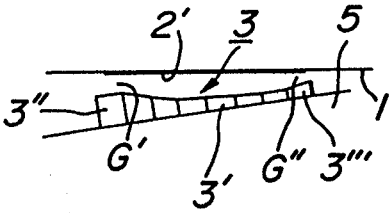
FIG. 2b PRIOR ART
Figure 3:
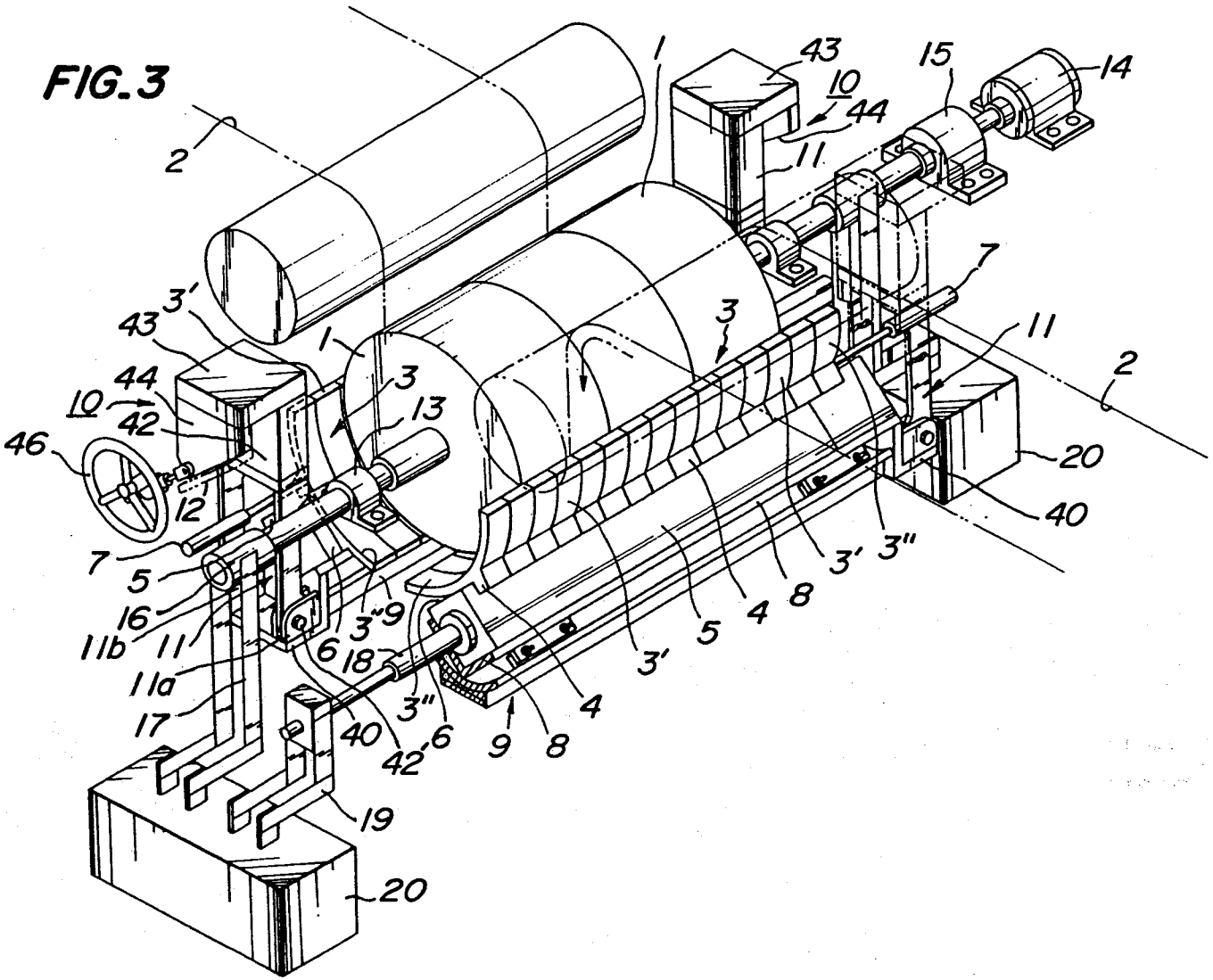
FIG. 3 is a perspective view of an arrangement of an electroplating path illustrating preferred embodiments of the invention.

Referring to FIG. 3 illustrating one embodiment of an electroplating bath of a radial cell type electroplating apparatus according to the invention, the electroplating bath comprises rotating drams 1 for supplying electric current. A metal strip 2 passes along lower halves of the drams 1 below a surface of an electrolyte (not shown for clarity). Anodes 3 consist of groups of consumable electrodes 3' arranged side by side in opposition to the metal strip with gaps relative thereto in radial directions of the rotating drums 1. As shown in the drawing, the anodes 3 are arranged on opposite sides of an axis of the rotating drums 1 upstream and downstream of a running direction of the strip 2 and anchored on a pair of electrode supports 5 fixed substantially in parallel with the axis of the drums 1 with the aid of protrusions 4 formed centrally on outer surface of the consumable electrodes 3' so as to permit the electrodes 3' to be moved in succession in the axial directions of the electrode supports 5. Each the consumable electrode 3' is generally made of arcuate zinc casting. Each the electrode support 5 has an electrode support surface 6 immediately below the protrusions 4 of the consumable electrodes 3' for supporting the outer surfaces of the electrodes 3'.

In order to correct increased gaps due to consumption of the anodes held on upper edge of the electrode supports, new consumable electrodes 3'' are supplied into the electroplating bath on both sides of the drums 1 and all the consumable electrodes 3' are moved by pushing the new electrodes with pushers 7. The waste electrodes 3''' which have been pushed are then taken out of the bath. In this manner, the anodes 3 are always renewed for successively correcting the consumed amount of the anodes used for a period of time. In this case, each the electrode support is slightly angularly arranged relative to a generator of the rotating drums with a gradient corresponding to a ratio of the consumed amount of the consumable electrode 3' while the new electrode 3'' becomes the waste electrode 3''' to the width of the anode. The electrode support 5 is supported with a gradient on a support trough 8 at a bottom of the bath, which is in turn held by a stationary base 9.

In this embodiment, each the stationary base 9 is suspended in the electrolyte bath by inclining lifts 11 of adjusting devices 10 arranged outside of the electrolyte bath and including inclining lift guides 12.

The arrangement shown in FIG. 3 includes bearings 13 for the drums 1, a motor 14 for driving the drums 1, a reduction gear 15, a current collector ring 16, cathode bus bars 17, current supply bars 18 for the electrode supports 5, anode bus bars 19 and rectifiers 20.

Figure 4A:
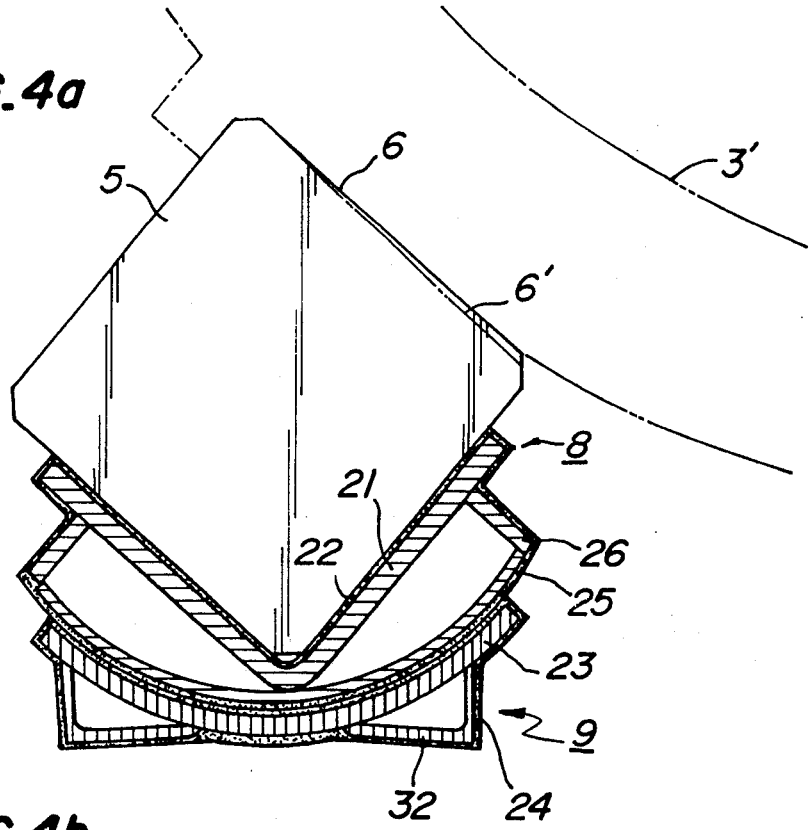
FIGS. 4*a* and 4*b* illustrating a preferred embodiment of support means for an electrode support according to the invention assumed in different positions.
Figure 4B:
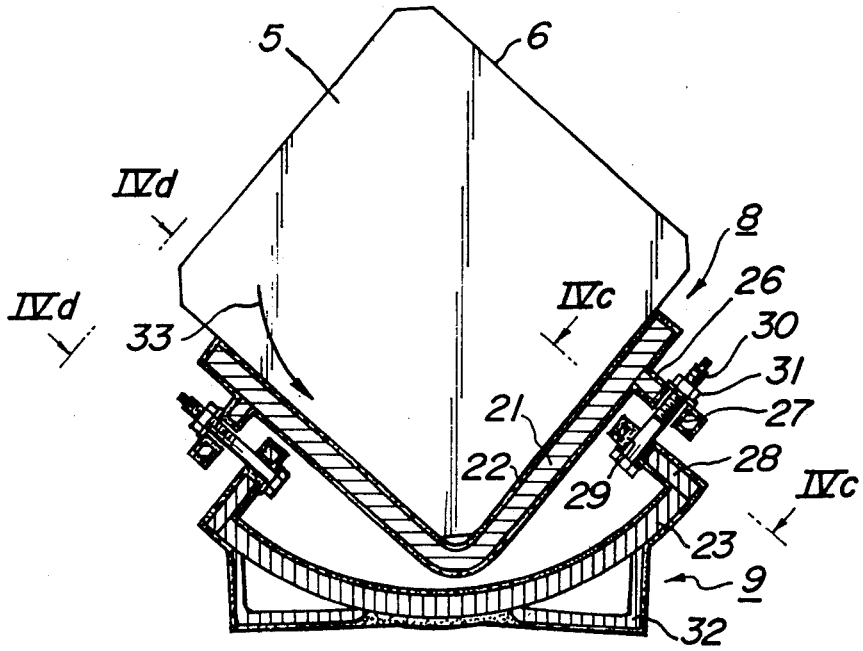

In order to stably support each the electrode support 5 made of a large square bar according to the invention, the support trough 8 comprises a core member 21 made of an L-shaped steel arranged so as to upward open its V-shaped groove and a corrosion-resistant coating such as a rubber lining 22 on the V-shaped groove, and the stationary base 9 comprises a trough-shaped core member 23 and a rubber lining 24 applied thereto as shown in FIGS. 4*a* and 4*b*.

Figure 4C:
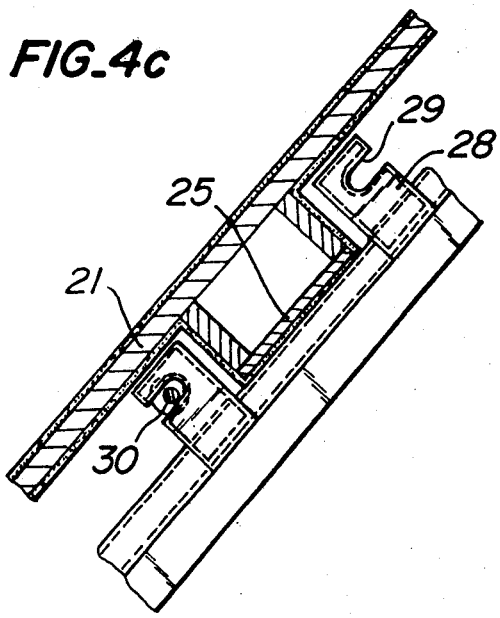
FIG. 4*c* is a sectional view taken along a line IVc—IVc in FIG. 4*b;*

As shown in FIGS. 4*a* and 4*c*, the support trough 8 is provided in the proximity of its ends with a pair of arcuate projection pieces 25 extending downward along the trough-shaped stationary base 9 and lined with a rubber lining 22 so as to permit the support trough 8 to be rotated about the axis of the electrode support 5.

Figure 4D:
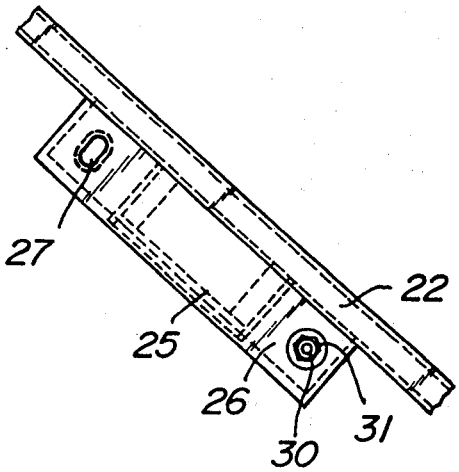
FIG. 4*d* is a side elevation as viewed in a direction shown by arrows IVd—IVd in FIG. 4*b;*

Connecting core members 26 serve to connect ends of the arcuate projection pieces 25 to the support trough 8 at its upper edges and have their length longer than a width of the arcuate projection pieces 25 as shown in FIG. 4*d*. Each the connecting core member 26 is formed with a pair of bolt apertures 27. On the other hand, the stationary base 9 is provided with a pair of ears 28 on both sides of each the arcuate projection piece 25. The support trough 8 is fixed to the stationary base 9 by means of adjusting bolts 30 with nuts 31 passing and fastening between notches 29 formed in the ears 28 and the bolt apertures 27 of the connecting core members 26. A reference numeral 32 denotes reinforcing core members for the stationary base 9 as shown in FIG. 4*b*.

With the above arrangement, when the support surface 6 of the electrode support 5 has been worn off as shown by a phantom line 6' in FIG. 4*a*, the inner adjusting bolt 30 shown in the right in FIG. 4*b* is loosened and on the other hand the outer adjusting bolt 30 shown in the left is tightened to rotate the support trough 8 in a direction shown by an arrow 33, so that the worn surface 6' is returned to the position of the surface 6 to easily eliminate the unevenness of the gaps at the upper and lower ends of the consumable electrode 3'.

Referring back to FIG. 3 including another embodiment of the invention, the base 9 with the support trough 8 for the electrode support 5 is suspended in the electrolyte bath by the inclining lifts 11 as above mentioned. An end piece 40 at each end of the base 9 is provided with a pair of crevice 11*a* and 11*b* connected by pins 42' to lower bifurcated ends of a hanging member 42. The hanging member 42 is movable in a direction of the inclining lift guide or translation guide 12 with the aid of a lower edge 44 of a hanging portion 43 upwardly extending from the surface (not shown) of the electrolyte and further extending downward beyond an upper edge of the bath. An reference numeral 46 denotes an operating wheel for the purpose.

Figure 5A:
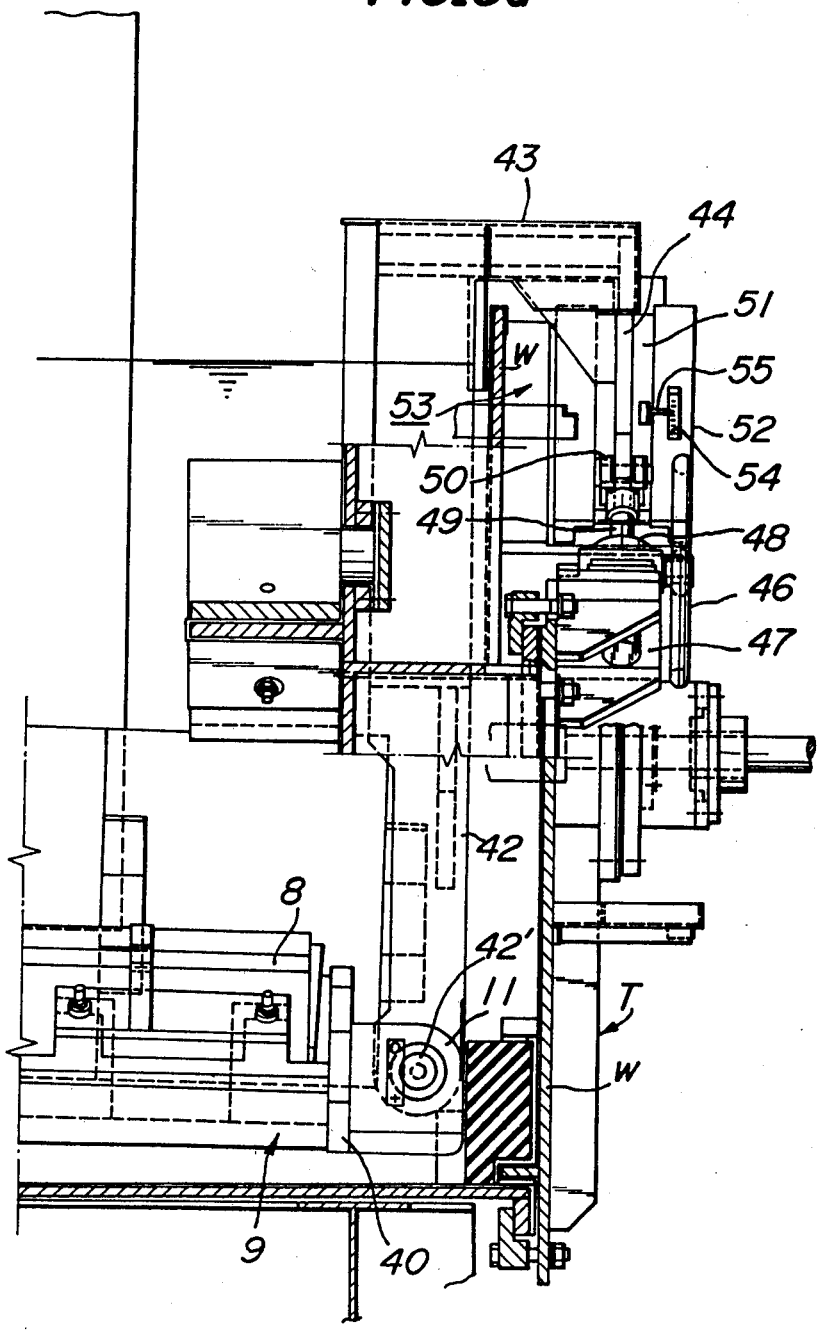
FIG. 5*a* is a side elevation illustrating a preferred embodiment of adjusting means to correct gaps between a metal strip to be plated and anodes to meet electrolytic conditions.
Figure 5B:
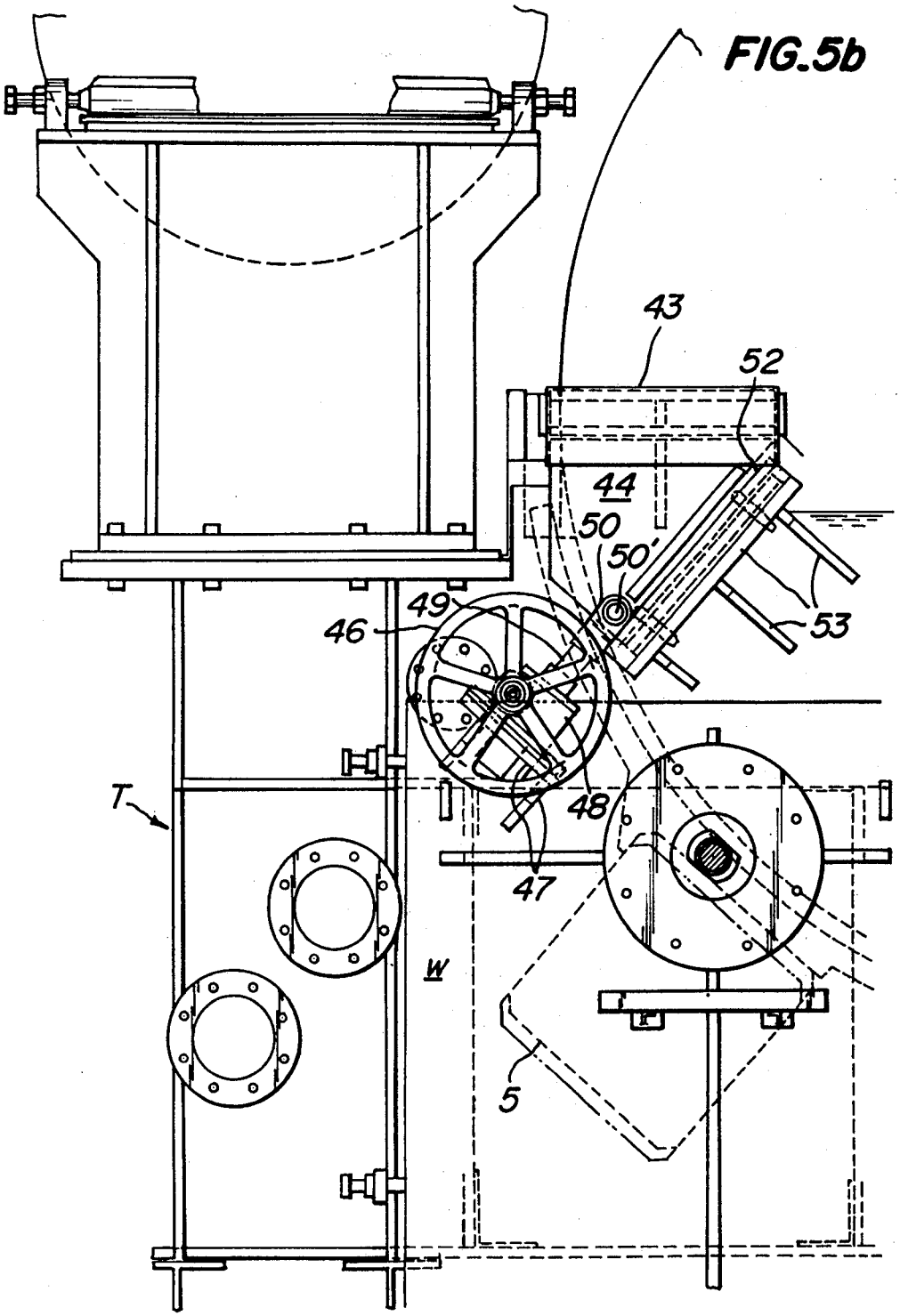
FIG. 5*b* is an end view of the adjusting means shown in FIG. 5*a*.

As shown in FIGS. 5*a* and 5*b*, the operating wheel 46 is fixedly keyed to an end of a worm shaft in a worm gear box 48 mounted on a bracket 47 fixed by welding to a sidewall w of the electrolyte bath. The lower edge 44 of the hanging portion 43 is connected by a pin 50' to and embraced by an end piece 40 of a screw threaded stem 49 actuated by a worm and a worm gear in mesh with each other in the gear box 48. On the other hand, the lower edge 44 of the hanging portion 43 is provided with a slider 51 having an inverted T-shaped cross-section slidably guided by a translation guide 52 provided on a bracket 23 fixed to the sidewall w of the bath. There are preferably provided an indicator 54 for indicating a skid distance of the slider 51 with a pointer 55.

The sliding direction of the slider 51 and hence the hanging portion 43 is located to be in parallel with a radial surface of the current supply rotating drums 1 including a center of the electrode support 5 as shown in FIG. 5*b*, so that the gaps between the anode 3 and the metal strip 2 can easily be adjusted without causing any unevenness in gap at upper and lower portions of the anode.

In the adjusting operation, the ends of the electrode supports 5 are separately adjusted so as to change the gradients relative to generators of the current supply rotating drums 1, so that such an adjustment enables the electroplating apparatus to be easily applicable to metal strips of various widths and the consumable electrodes 3' to be effectively utilized so as to lower the unit price of the anodes.

As can be seen from the above description, according to the invention, it is therefore possible to simply and easily prevent the failures due to unevenness of gaps between ends of consumable electrodes resulting from unavoidable irregular wear on support surfaces of electrode supports caused by the replenishing operation or successive movement of consumable electrodes along the electrode supports during the electrolytic operation progressively replenishing anodes consisting of the consumable electrodes in a radial cell type electrolyte bath. According to the invention, moreover, gaps between assembled electrodes and a metal strip to be plated can be externally adjusted in width directions of the strip to meet present electrolytic conditions, thereby eliminating the edge-overcoating which would occur when the width of the strip changes to be wider and making proper the consuming rate of the electrodes until wasted to lower the unit price thereof.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrode support device for a continuous electroplating bath, including current supply rotating drums whose parts are immersed in said electroplating bath, a metal strip to be plated being trained about the immersed parts of the rotating drums, and a number of arcuate consumable electrodes arranged side by side along generators of said rotating drums and successively movable on support surfaces of electrode supports so as to supply new consumable electrodes at one ends of the arranged electrodes and remove cosumed electrodes from the other ends, said support device comprising adjusting means for adjusting said electrode supports to remove any unevenness of gaps between said metal strip and said consumable electrodes.

2. An electrode support device as set forth in claim 1, wherein said adjusting means for each said electrode support comprises a support trough supporting said electrode support and a stationary base rotatably supporting said support trough so as to permit said support surface of said electrode support to be adjustably tilted and fixedly supporting said support trough thereon by means of adjusting bolts.

3. A electrode support device as set forth in claim 2, wherein said support trough comprises a core member made of an L-shaped steel arranged so as to upward open its V-shaped groove and a corrosion-resistant coating on the V-shaped groove, and said stationary base comprises a trough-shaped core member and a lining applied thereto.

4. An electrode support device as set forth in claim 3, wherein said support trough is provided in the proximity of its ends with a pair of arcuate projection pieces along the trough-shaped core member of said stationary base and with connecting core members connecting ends of said arcuate projection pieces to said support trough at its upper edges and having lengths longer than a width of the arcuate projection pieces, said arcuate projection pieces and said connecting core members being lined with corrosion-resistant coatings, and said stationary base is provided with a pair of ears on both sides of each the arcuate projections piece of said support trough, each the ear being formed with a notch for fixing said support trough onto said stationary base by means of adjusting bolts and nuts extending between said notches and apertures formd in said arcuate projection pieces.

5. An electrode support device as set forth in claim 1, wherein said adjusting means for each said electrode support comprises hanging members each supporting each end of said electrode support and upwardly extending from a surface of an electrolyte and further extending downward beyond an upper edge of a bath of the electrolyte, and translation guides each slidably guiding the lower end extending downward of each said hanging member in a direction substantially in parallel with a radial surface of said current supply rotating drums.

6. An electrode support device as set forth in claim 5, wherein said adjusting means for each said electrode support further comprises, for each end of the electrode support, an operating wheel keyed to an end of a worm shaft in a worm gear box mounted on a bracket fixed to the electrolyte bath, end piece of a screw threaded stem connected to said lower end of said hanging member and actuated by a worm and a worm gear in mesh with each other in said worm gear box, and a slider having an inverted T-shaped cross-section provided on said lower end of said hanging member and slidably guided on said translation guide.

* * * * *